US006960121B2

(12) United States Patent
Klink et al.

(10) Patent No.: US 6,960,121 B2
(45) Date of Patent: Nov. 1, 2005

(54) METHOD OF HONING BORES

(75) Inventors: Ulrich Klink, Neuffen (DE); Joachim Wiederhold, Schorndorf (DE); Jürgen Wolf, Ostfildern (DE)

(73) Assignee: Gehring GmbH & Co. KG, Ostfildern (DE)

( * ) Notice: Subject to any disclaimer, the term of this patent is extended or adjusted under 35 U.S.C. 154(b) by 0 days.

(21) Appl. No.: 10/708,231

(22) Filed: Feb. 18, 2004

(65) Prior Publication Data

US 2005/0130560 A1 Jun. 16, 2005

(30) Foreign Application Priority Data

Dec. 10, 2003 (DE) ..... 103 58 150

(51) Int. Cl.[7] ..... B24B 1/00

(52) U.S. Cl. ..... 451/51; 451/28; 451/57; 451/61; 451/177; 451/294; 451/440

(58) Field of Search ..... 451/28, 51, 57, 451/61, 177, 294, 440

(56) References Cited

U.S. PATENT DOCUMENTS 3,998,011 A * 12/1976 Corley ..... 451/470
5,601,476 A * 2/1997 Maier et al. ..... 451/51

FOREIGN PATENT DOCUMENTS

EP 0 535 210 B1 4/1993

OTHER PUBLICATIONS

Ulrich Klink et al, Honen—Fortschritte durch optimierte Werkzeuge und Prozesse (two-part article); VDI-Z, vol. 6 (pp. 49-56) and vol. 7 (pp.57-62), 2001, Springer-VDI-Verlang GmbH & Co. KG, Düsseldorf, Germany.

* cited by examiner

*Primary Examiner*—Joseph J. Hail, III
*Assistant Examiner*—Shantese L. McDonald
(74) *Attorney, Agent, or Firm*—Gudrun E. Huckett

(57) ABSTRACT

In a method for honing a bore having first and second sections sequentially arranged in an axial direction of the bore, wherein the first section is hardened so that the first and second sections have different hardness, a honing tool is radially supported by positioning guides of the honing tool on the second bore section. first section is machined with honing stones arranged on the honing tool to remove material from the first section. During machining of the first section, the honing tool is expanded by feeding the honing stones according to a defined feeding mode against a surface of the first section by a force-guided electro-mechanical advancement. During machining of the first section, the working stroke of the honing tool is adjusted continuously at least toward the end of the honing process. Feeding of the guides is realized independently of feeding of the honing stones.

12 Claims, 4 Drawing Sheets

METHOD OF HONING BORES

BACKGROUND OF INVENTION

1. Field of the Invention

The invention relates to a method of honing bores, in particular, cylinder bores in crankcases of internal combustion engines.

2. Description of the Related Art

In truck engines, cylinder linings that are made by spin casting are often employed as piston bearing surfaces because this material is more wear resistant than the material of the engine block. Such cylinder liners however result in relatively high costs with regard to manufacture as well as assembly of the engine block. Therefore, it has already been proposed to partially harden the piston bearing surface of the engine block within the upper reversing area of the piston movement in order to achieve in this way a higher wear resistance. In this way, a separate cylinder liner is not needed. For example, hardening can be achieved by using a method employing a laser; however, the more economical and cost efficient alternative is induction hardening. When using induction hardening, non-concentric bore constrictions result; this prevents the use of conventional honing processes.

For processing partially hardened cylinder bores in crankcases, the method of coaxial honing has been developed; it is described, for example, in European patent 0 535 201 B1 or in VDI-Z, volume 6 (2001), pp. 49ff, in the article "Honen—Fortschritte durch optimierte Werkzeuge und Prozesse" (Translation: Honing—Advances through Optimized Tools and Processes) authored by U. Klink and G. Flores. The tool described in this article contains two sets of tool members that can be radially advanced or fed independently from one another. The lower set of tool members consists of hard metal guides that rest against the bore wall that has been pre-machined. In this way, the tool is oriented with regard to direction and central position relative to the bore axis. The diamond honing stones of the upper tool member set are subsequently expanded and machine the hardened bore section with the constrictions. The feed of both sets of tool members and thus their expansion is carried out separately. In this connection, feeding of guides can be realized hydraulically while the diamond honing stones are advanced electro-mechanically.

SUMMARY OF INVENTION

It is an object of the present invention to optimize honing of bores that have a hardened section. It is therefore the object of the present invention to further develop a method for honing bores, in particular, cylinder bores in crankcases of internal combustion engines, such that honing is more efficient and performed with greater dimensional precision.

In accordance with the present invention, this is achieved for two sections of the surface to be machined in the bores that have different hardness and are sequentially arranged in the axial direction of the bore, which sections are first subjected to a pre-machining step and subsequently partially hardened, in that in one of the sections the honing tool is radially supported by means of guides arranged on the honing tool while honing stones arranged on the honing tool machine the hardened section so that material is removed, wherein feeding of the guides is realized independent of feeding of the honing stones, and wherein feeding of the honing stones is realized as a force-guided electro-mechanical advancement and the working stroke of the honing tool is adjusted continuously at least towards the end of the honing process and the honing tool is expanded according to a defined feeding mode.

According to an advantageous embodiment of the method, the adjustment of the working stroke of the honing tool can be carried out toward the adjoining section of reduced hardness of the bore. By this measure, a gradual transition between the honed and the unhoned section is achieved, i.e., between the soft section and the hardened section of the bore. In another embodiment of the method according to the invention, the adjustment of the working stroke of the honing tool is carried out in the direction toward the open end of the hardened section. In this way, a slight alteration of the bore opening can result or a burr that is present can be removed.

Inasmuch as a particularly smooth transition from the hardened section to the softer section is to be achieved and additionally the bore opening is to be machined, it is advantageous to carry out the adjustment of the working stroke of the honing tool in the direction of the adjoining section of the bore as well as in the direction of the open end of the hardened section.

In the case of certain bores, it can be advantageous that the end of the bore has a counterbore so that the honing process in this area can be designed accordingly. The term counterbore is used in fine machining to define an outwardly widening contour near the end of a bore. In this connection, the shape of the bore deviates from the ideal shape of a cylinder. This means an increase of the bore diameter at the respective end of the bore. The counterbore produced accordingly relieves the subsequent honing operation in that at the upper end of the bore less material must be removed.

In the case of inductive hardening, no homogenous hardening occurs in the upper area of the bore; instead, corresponding to the hardening tool, hardened longitudinal strips with soft intermediate spaces are formed. As a result of these areas with different hardness in the hardened section of the bore, different removal rates during honing must be expected. In order to be able to maintain a constant protrusion of grains relative to the binding layer of the honing stones, an alternating change of the rotary direction of the honing tool can be carried out in different ways. One possibility resides in that the direction change of the honing tool is carried out after every machining cycle. However, it may also be expedient to carry out the rotary direction change of the honing tool once during each machining cycle, for example, upon reaching half the thickness of the material layer to be removed. Another possibility resides in that the rotary direction change is carried out at least twice during a machining cycle.

Moreover, it is advantageous to measure the advancing (feeding) force of the honing stones continuously and to maintain the advancing force within a pre-determined bandwidth of an upper limit and a lower limit and to perform the expansion of the honing stones in steps when reaching the lower limit of the advancing force, respectively. In this way, during the entire honing operation the advancing force is maintained constant within narrow limits so that undesirably high pressing forces of the honing stones on the bore wall can be prevented.

DETAILED DESCRIPTION

Figure 1:
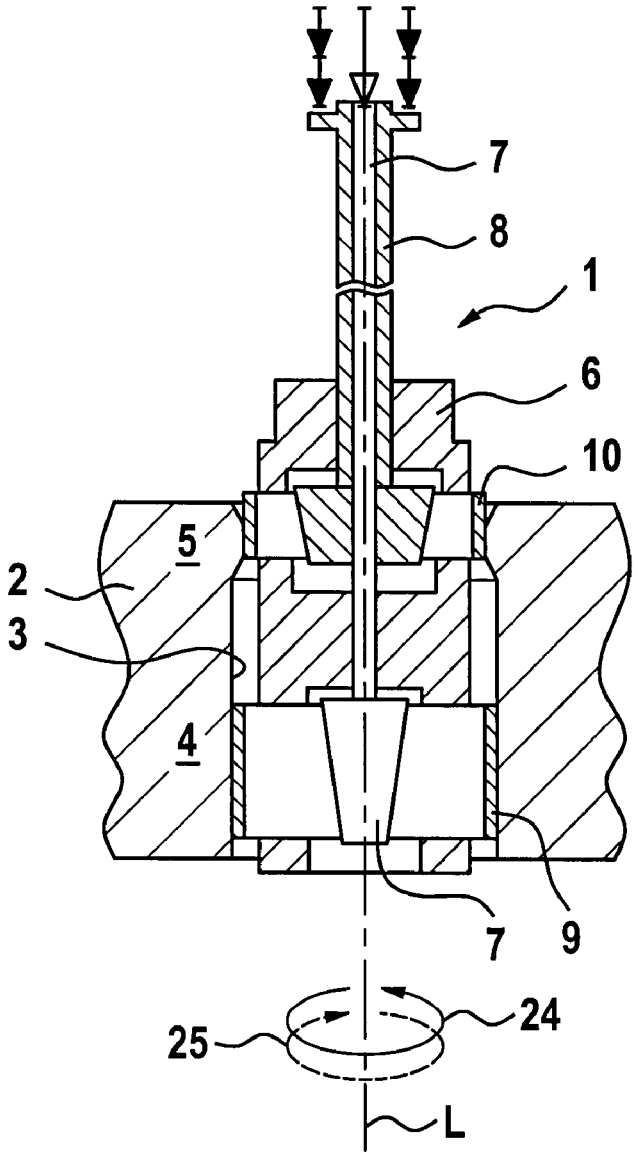
FIG. 1 is a longitudinal section of a honing tool for coaxial honing positioned in a bore with a hardened section.

FIG. 1 shows a longitudinal section of a honing tool 1 which is suitable for coaxial honing. The honing tool 1 is positioned in a bore 3 of a workpiece 2 wherein the workpiece 2, for example, is the crank case of an internal combustion engine. The bore 3 comprises a section 4 that is not hardened and a hardened section 5, wherein the hardened section 5 is provided at the upper end of the bore 3, as shown in FIG. 1. The hardened section 5 can be produced by induction hardening, for example. The honing tool 1 comprises a tool head 6 with radially expandable honing stones 10 and radially expandable guides 9. The guides 9 are supported on the bore wall within the section 4 that is not hardened, while the honing stones 10 rest against the wall in the hardened section at a predetermined force load. A first advancing device 7 for the guides 9 and a second advancing device 8 for the honing stones 10 are provided. The second advancing device 8 is a force-guided electro-mechanical step adjuster. The honing tool 1 can be driven about its longitudinal axis L in a first direction of rotation 24 and in a second direction of rotation 25.

Figure 2:
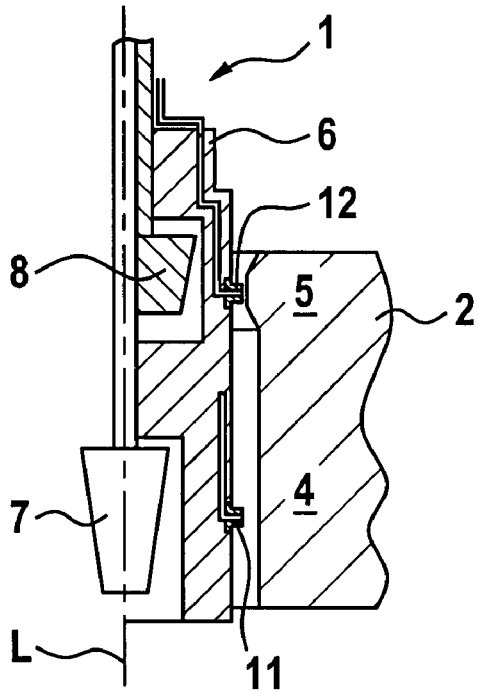
FIG. 2 is a section of a plane that is displaced relative to the view of FIG. 1 by an angle about the longitudinal axis of the honing tool of FIG. 1.

FIG. 2 shows a section according to FIG. 1 in a plane that is moved about an angle about the longitudinal axis L of the honing tool 1. In this plane, the tool head 6 is provided with lower air measuring nozzles 11 for performing reference measurements and upper air measuring nozzles 12 for performing process measurements during honing in the hardened section 5.

Figure 3:
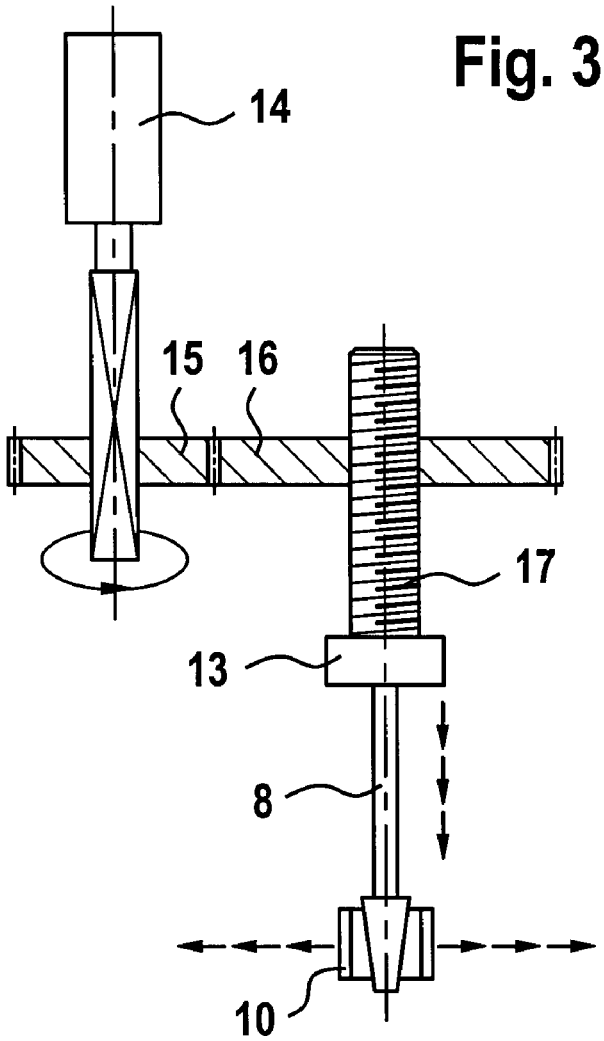
FIG. 3 is a schematic illustration of the advancing (feeding) device of the honing stones.

FIG. 3 shows a schematic illustration of the adjusting (feeding) device for the honing stones 10. For controlling the advancing movement, a spindle 17 is provided with a force measuring device 13 that measures the force with which the honing stones 10 are forced against the surface to be machined wherein between the honing stones 10 and the force measuring device 13 only the second advancing device 8 is present. In this regard, the signal that is measured by the force measuring device 13 corresponds to the actual value at the honing stones 10. The advancing device comprises also a stepper motor 14 whose output shaft acts on a gear 15 that meshes with a second gear 16; the gear 16 is supported on the spindle 17. As soon as the demand for further advancement is present and a corresponding signal is sent to the stepper motor 14, the stepper motor 14 drives the gear 15 by a certain rotational angle; in turn, the other gear 16 is also rotated and, in this way, the spindle 17, as illustrated in FIG. 3, is moved downwardly. In this way, the honing stones 10 are radially expanded or spread apart by the predetermined amount.

Figure 4:
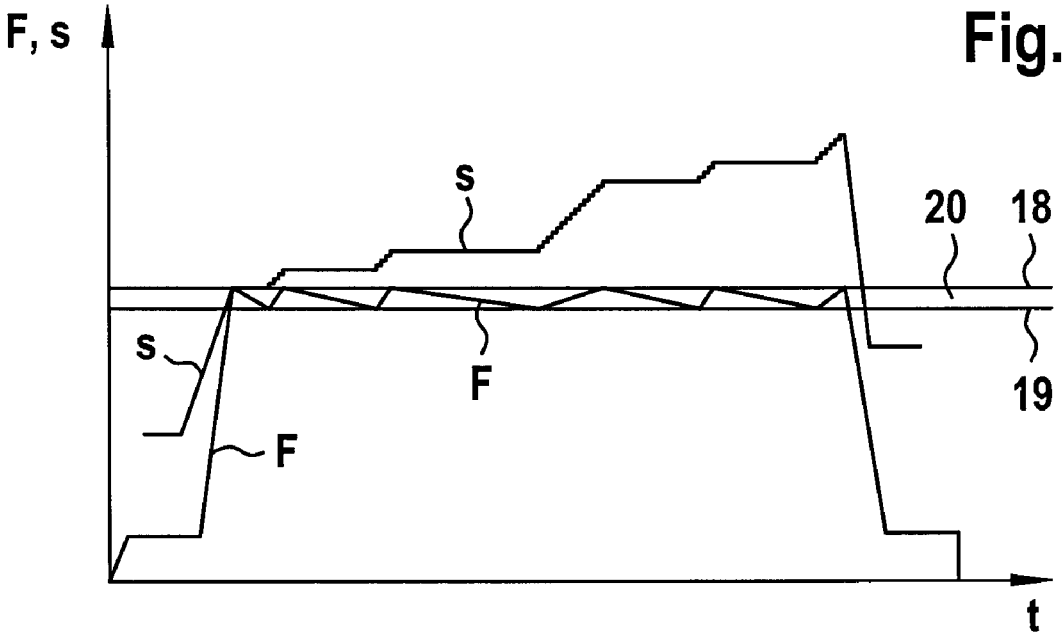
FIG. 4 is a diagram showing the course of advancing of the honing stones.

FIG. 4 shows a diagram of the course of advancement of the honing stones as a function of the advancing force over the duration of honing. In the diagram, F refers to the course of the advancing force that is plotted against the axis of time t. The reference sign s refers to the advancing stroke within the same temporal course t. For the advancing force a nominal value range 20 is provided that is defined by an upper limit 18 and a lower limit 19. It is obvious that the nominal value range 20 is adhered to within relatively narrow limits. The force-controlled electro-mechanical honing stone advancement is a particularly suitable configuration for performing the method according to the present invention. It combines in a suitable way the features of a positive-locking stepped tool expansion with the functions of a force-locking permanently acting advancing device.

The constructive configuration of the advancing chain, as illustrated in FIG. 3, is comprised of a stepper motor 14, a transmission with gears 15, 16 for converting a rotational movement into an axial movement, a force measuring device 13 between the threaded member or spindle 17, and the advancing device 8 of the honing tool 1. During the entire honing operation, the force-controlled electro-mechanical adjustment according to FIG. 4 keeps the advancing force constant within narrow limits, i.e., within the upper limit 18 and the lower limit 19. In this way, approximately constant advancing forces F act on the bore wall and on the working surface of the honing stones. As long as the advancing force F is within the determined nominal range, no further expansion occurs. Only when the advancing force F decreases as a result of the increasing material removal and the lower limit 19 is reached in turn, further expansion (optionally in several steps, as indicated in FIG. 4) is performed until the upper limit for the advancing force F is reached again. In this way, a continuous increase of the advancing pressure is prevented, and a high degree of dimensional stability and shape stability is achieved because the advancing stroke s and the material removal are substantially identical.

The honing operation is terminated when the expansion travel or stroke s that is preset or computed by the honing program is reached with the predetermined advancing force F. In this way, not only the expansion stroke is decisive for the process termination but also the contacting force that is acting on the working surface of the honing stone at the time of termination. In this way, a high dimensional stability of +/−0.2 $\mu$m is possible in individual cases. In this way, under certain circumstances, gear wheels, connecting rod eyes, or cylinder bores can be machined within a range of a few micrometers by means of the first honing operation without requiring additional on-line measuring devices or after process measuring devices.

The machining operation of coaxial honing is realized in the range of shape deviations of the bores that in the present example have been caused by hardening and the resulting distortions. They are represented by eccentric constrictions of the bore as is illustrated, for example, in FIG. 1. For example, an operating mode can be employed that is illustrated in FIG. 5 in order to obtain a gradual transition from the unhardened to the hardened section.

Figure 5:
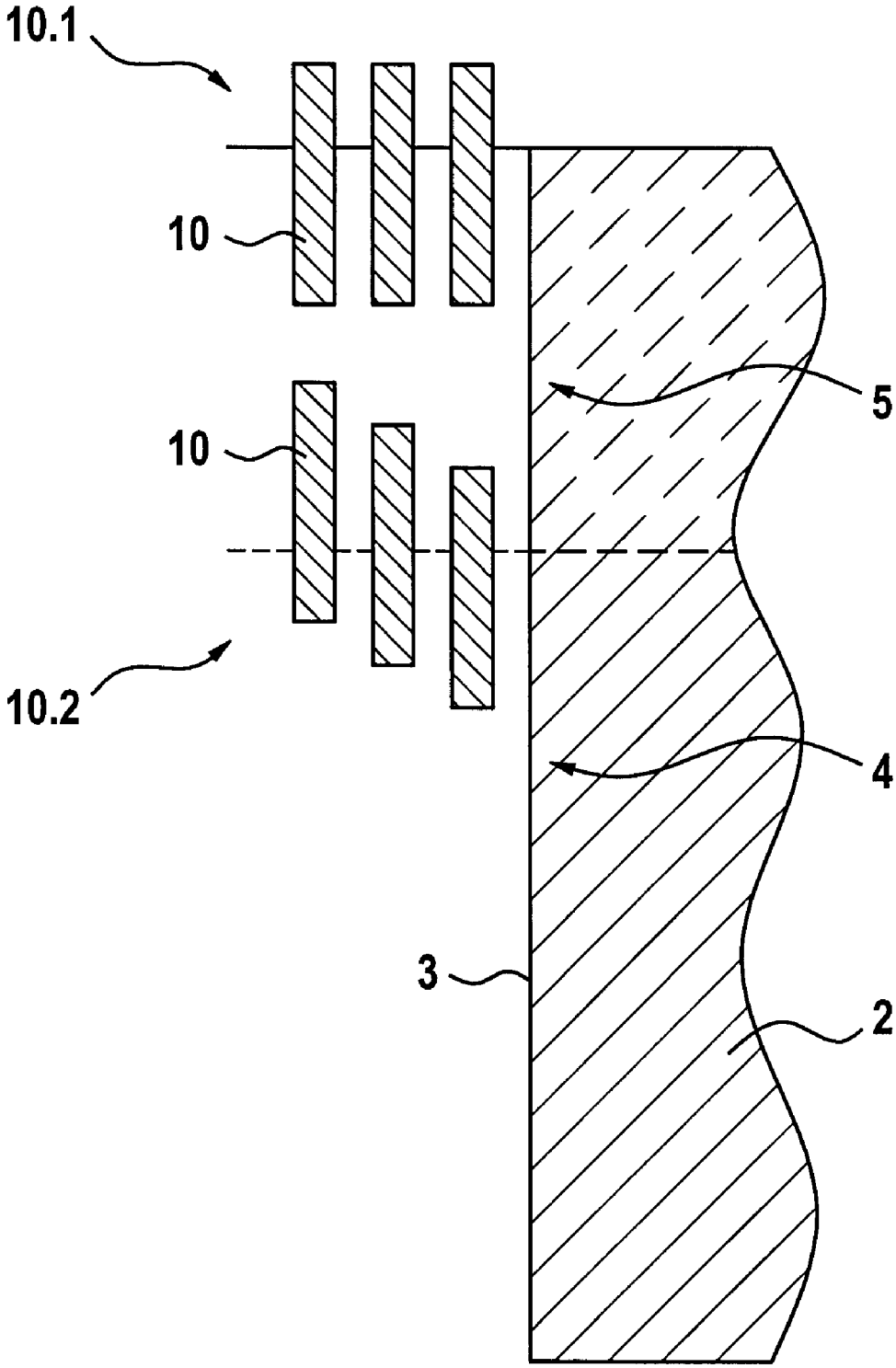
FIG. 5 shows a schematic illustration relating to the change in working stroke.

FIG. 5 shows a section of the bore 3 in the workpiece 2 indicating the sections 4 and 5. The main removal is achieved initially by the initial stroke position. In this connection, the machining range is limited at the top by the bore edge, as illustrated by the upper stroke position 10.1. Moreover, the machining area is limited at the bottom by the lower edge of the honing stones 10 at the lower stroke reversing point that is located at the transition from the hardened section 5 to the section 4 that is not hardened. This stroke reversing point is referred to as the lower stroke position 10.2. In order to be able to achieve a gradual transition between the honed and the unhoned areas, i.e., between the relatively soft section 4 and hardened section 5 of the bore 3, the last machining strokes are increased at the lower end by a few millimeters, respectively. This movement of the stroke position in the downward direction is illustrated in FIG. 5 by the changed position of the honing stones 10 at the stroke reversing point (10.2). In this way, the effective area of the honing stones 10 extends past the area that has been machined previously and passes over into the previously unmachined section 4 of the bore 3. In this way, continuous (step-free) transitions can be achieved.

Figure 6:
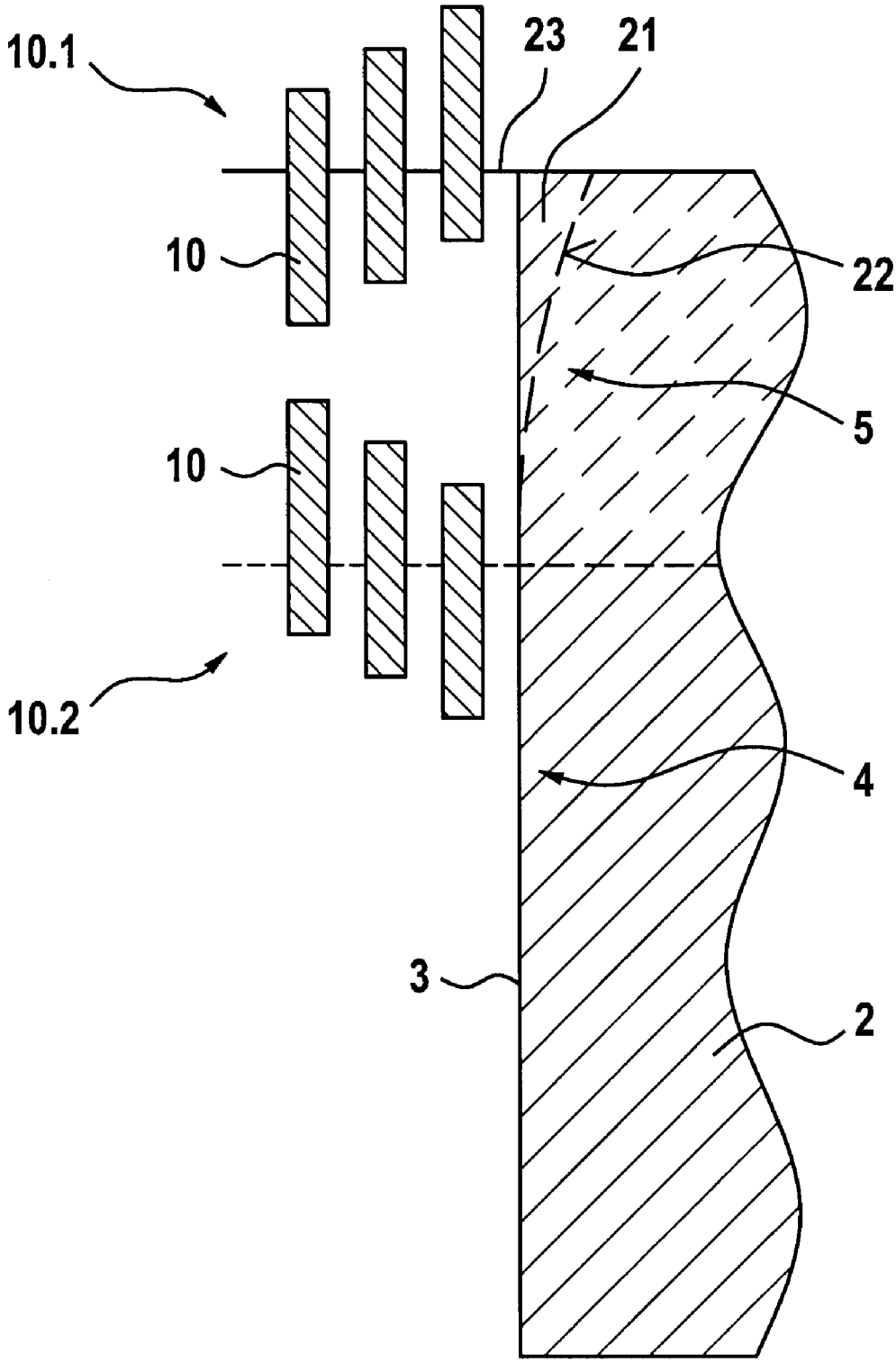
FIG. 6 is an alternative embodiment with respect to FIG. 5.

FIG. 6 shows an embodiment variant of FIG. 5. In FIG. 6 processing of the hardened section 5 of the bore is performed such that toward the end of the honing operation a continuous change of the upper honing position 10.1 is realized by moving the reversing point farther out of the hardened section 5. Of course, this stroke displacement in the direction of the open end 23 of the bore 3 can also be combined with the displacement of the lower stroke position 10.2 illustrated in connection with FIG. 5. Depending on the point in time during the processing cycle when the change is realized, i.e., even significantly before the end of the honing process, and depending on the absolute value of the displacement and/or of the contact pressure, the bore 3 can be designed at the open end 23 as a rounded contour 22 as illustrated in FIG. 6 in a dashed line; this provides a counterbore 21 of the bore 3.

As already mentioned, the honing tool illustrated in FIG. 1 is driven alternatingly in both rotational directions. The point in time of reversal of the rotational directions can be determined based on the duration of the expected honing process so that it may be sufficient for short machining cycles to change the rotational direction after completion of the cycle. For longer processing cycles, the directional change should occur during the cycle; this can be carried out once or several times, as needed.

While specific embodiments of the invention have been shown and described in detail to illustrate the inventive principles, it will be understood that the invention may be embodied otherwise without departing from such principles.

What is claimed is:

1. A method for honing a bore having a first section and a second section sequentially arranged in an axial direction of the bore and possibly not concentric to one another, wherein the first section is hardened so that the first and second sections have different hardness; the method comprising the steps of:

radially supporting a honing tool on a wall of the second section of the bore by feeding guides of the honing tool so as to rest on the wall of the second section of the bore;

honing the first section with honing stones arranged on the honing tool to remove material from the first section;

during honing of the first section, expanding the honing tool by feeding the honing stones, independently of feeding the guides, according to a defined feeding mode against a surface of the first section by a force-controlled electro-mechanical advancement;

during honing of the first section, continuously adjusting a working stroke of the honing tool at least toward the end of the step of honing.

2. The method according to claim 1, wherein in the step of adjusting the working stroke of the honing tool the working stroke is moved in a direction toward the second section.

3. The method according to claim 1 wherein in the step of adjusting the working stroke of the honing tool the working stroke is moved in a direction toward an open end of the first section.

4. The method according to claim 1, wherein in the step of adjusting the working stroke of the honing tool the working stroke is moved in a direction toward the second section and in a direction toward the open end of the first section.

5. The method according to claim 1, further comprising the step of producing a counterbore at an open end of the first section.

6. The method according to claim 1, wherein the step of honing of the first section includes the step of driving the honing tool alternatingly in different rotary directions.

7. The method according to claim 6, wherein a change of the rotary direction of the honing tool is carried out after a honing cycle, respectively.

8. The method according to claim 6, wherein a change of rotary direction of the honing tool is realized once during a honing cycle.

9. The method according to claim 8, wherein the change of rotary direction is carried out upon reaching half a thickness of a material layer to be removed during honing.

10. The method according to claim 6, wherein a change of rotary direction is carried out at least twice during a honing cycle.

11. The method according to claim 1, wherein during honing an advancing force of the honing stones is measured continuously and maintained within a predetermined range defined by an upper limit and a lower limit, and wherein according to the defined feeding mode the honing stones are expanded in steps when the lower limit of the advancing force is reached, respectively.

12. The method according to claim 1, wherein the bore is a cylinder bore in a crankcase of an internal combustion engine.

* * * * *